US006484596B2

(12) United States Patent
Puchas

(10) Patent No.: US 6,484,596 B2
(45) Date of Patent: Nov. 26, 2002

(54) CRANKSHAFT STARTER-GENERATOR

(75) Inventor: Christian Puchas, Ingersheim (DE)

(73) Assignee: Kontec GmbH, Korntal-Müchingen (DE)

( * ) Notice: Subject to any disclaimer, the term of this patent is extended or adjusted under 35 U.S.C. 154(b) by 0 days.

(21) Appl. No.: 09/735,078

(22) Filed: Dec. 12, 2000

(65) Prior Publication Data

US 2001/0003923 A1 Jun. 21, 2001

(30) Foreign Application Priority Data

Dec. 14, 1999 (DE) ..... 199 60 366

(51) Int. Cl.[7] ..... F02N 11/04

(52) U.S. Cl. ..... 74/6; 74/15.63; 123/179.28; 290/46

(58) Field of Search ..... 74/6–9, 15.63; 310/85, 86, 89; 123/192.2, 179.28, 179.29; 290/46

(56) References Cited

U.S. PATENT DOCUMENTS 1,770,468 A 7/1930 Ford
4,020,935 A * 5/1977 Mortensen ..... 192/104 R
4,615,227 A * 10/1986 Stockton ..... 74/7 E
4,695,261 A * 9/1987 Broughton et al. ..... 440/900
5,418,400 A * 5/1995 Stockton ..... 290/46
5,966,985 A * 10/1999 Shuto et al. ..... 74/7 C
6,179,582 B1 * 1/2001 Matsunaga et al. ..... 417/360

FOREIGN PATENT DOCUMENTS

DE 196 31 384 10/1997
DE 199 41 705 3/2000

* cited by examiner

*Primary Examiner*—David A. Bucci
*Assistant Examiner*—Timothy McAnulty
(74) *Attorney, Agent, or Firm*—Collard & Roe, P.C.

(57) ABSTRACT

The invention relates to a crankshaft starter-generator for an internal combustion engine wherein the starter-generator is drive-coupled to a crankshaft of the internal combustion engine and serves both as the starter and the generator. A stator of the starter-generator is coupled with torsional strength to a motor block of the internal combustion engine. A rotor of the starter-generator is drive-coupled with the crankshaft of the internal combustion engine. A carrier is arranged coaxially with respect to the crankshaft and drive-coupled thereto. The rotor is drive-coupled to the carrier. The rotor and the carrier are arranged coaxially with respect to each other and are coupled to one another with torsional strength. Furthermore, the stator is arranged on the inside, and the rotor is arranged on the outside of the starter-generator.

16 Claims, 2 Drawing Sheets

CRANKSHAFT STARTER-GENERATOR

BACKGROUND OF THE INVENTION

1. Field of the Invention

The invention relates to a crankshaft starter-generator for an internal combustion engine.

2. The Prior Art

A crankshaft starter-generator is disclosed in German Patent 199 41 705 A1. In this case, the stator of the starter-generator is torsionally coupled with a motor block of the internal combustion engine. The rotor of the starter-generator is coupled by torsional strength with the crankshaft of the internal combustion engine. Furthermore, a belt pulley is coaxially arranged with the crankshaft forming a carrier that is drive-coupled with the crankshaft and with the engine. The starter-generator is mounted eccentrically in relation to the crankshaft, and laterally on the motor. However, additional installation space is required for such an arrangement.

German Patent 19631 384 C1 discloses an electrical machine with a stator and a rotor arranged in the drive train of a driving aggregate. The rotor may be mounted, for example on a crankshaft of an internal combustion engine. An insulation against vibration is installed in the drive train. This insulation is integrated in the rotor of the electrical machine. The electrical machine may have the function, for example of a starter-generator.

Another starter-generator is disclosed in U.S. Pat. No. 1,770,468. The rotor of this starter-generator is connected with torsional strength to the crankshaft and to a coaxially arranged belt pulley. The stator of the starter-generator is connected to the body of the vehicle.

A crankshaft starter-generator is also disclosed in the prospectus "Der Sachs Dynastart—Die neue Energie fürs Auto" [The Sachs DynaStart—The New Energy for the Car]. This crankshaft starter-generator is drive-coupled with a crankshaft of the internal combustion engine and serves both as a starter and generator. A stator of the starter-generator is mounted via a carrier on a motor block of the internal combustion engine and is coupled with torsional strength to the motor block. A rotor of the starter-generator is secured on a flywheel of the internal combustion engine, whereby the flywheel is torsionally coupled to the crankshaft of the internal combustion machine. The rotor is coupled with torsional strength to the crankshaft as well. The flywheel of the internal combustion engine is usually located between the motor block and the inlet side of a clutch. The output side is coupled with the transmission. However, the components located in this area are subjected to high temperatures. Therefore, the starter-generator requires intensive cooling in order to avoid damage to its windings. A further drawback of the known starter-generator is its integration into the drive train of the internal combustion engine which requires a change in the construction of the drive train. Furthermore, integrating the starter-generator into the drive train changes the installation measurements of the internal combustion engine, so that structural changes have to be made in the vehicle.

Furthermore, there is a need for installing starter-generators with different capacities depending on the type of vehicle or vehicle equipment involved. These starter-generators, however, differ from each other by their installation measurements, so that structural adaptations are also required.

SUMMARY OF THE INVENTION

An object of the present invention is to provide a compact design for a starter-generator that can be integrated into a conventional drive train of an internal combustion engine.

These objects are accomplished by providing a starter-generator drive-coupled to the crankshaft of an internal combustion engine. A stator is disposed on the inside of the starter-generator, and is torsionally coupled to the motor block. A rotor is disposed on the outside of the starter-generator and is drive-coupled with the crankshaft. A carrier is coaxially disposed with respect to the crankshaft and the rotor. The carrier is drive-coupled to the crankshaft and torsionally coupled to the rotor. Therefore, a compact type of construction is achieved for the starter-generator. This type of construction permits direct transmission of the force or moment between the crankshaft and the rotor via the carrier.

In the present invention, the starter-generator is arranged on the side of the internal combustion engine that is facing away from the driven side of the crankshaft, and the rotor is connected with the crankshaft via the carrier. Internal combustion engines of the type commonly known, mount the starter-generator at the end of the motor block that is associated with a belt drive of the internal combustion engine. Therefore, the starter-generator is located in a site where a reduction in the development of heat occurs, compared to a position located between the transmission and the motor block. A flow of cooling air can be directed to the site in a relatively simple manner. However, another important advantage of the starter-generator defined by the invention is that no structural changes are needed to install the starter-generator. It is also possible to install starter-generators with different dimensions depending on the required capacity, which makes it possible to realize a large variety of different types without requiring costly structural changes to the individual internal combustion engines.

According to a preferred embodiment of the invention, the carrier supports a belt pulley of a belt drive of the internal combustion engine. The carrier may be in the form of a belt pulley, which enhances a compact type of construction.

Preferably, the carrier or belt pulley and the rotor form an integral unit, i.e. the carrier or the belt pulley are formed on the rotor, or the rotor is formed on the carrier, or on the belt pulley. This facilitates the compact type of construction for the starter-generator.

In another preferred embodiment of the invention, the rotor contains, on a side facing away from the crankshaft, a projecting collar on which the carrier or belt pulley is formed. Therefore, different diameters can be obtained for the rotor and the carrier, or belt pulley in a simple way.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
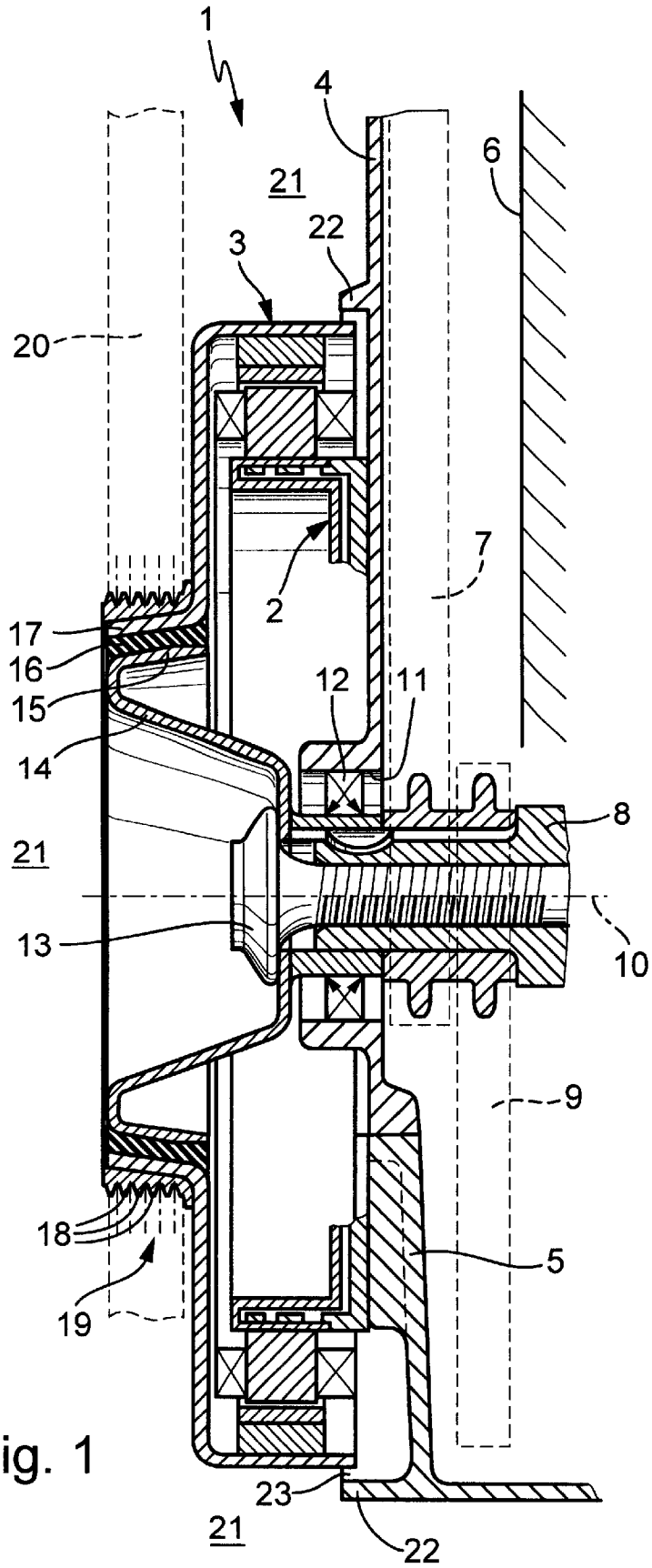
FIG. 1 shows a longitudinal cross sectional view through a crankshaft starter-generator according to a first embodiment of the invention.

Referring now in detail to the drawings and, in particular, FIG. 1 , a crankshaft starter-generator 1 is shown which is also called a starter-generator 1. A stator 2 is located on the interior side, and a rotor 3 located on the external side.

Stator 2 is secured both on a control housing cover 4 and on an oil sump 5, whereby control housing cover 4 and oil sump 5 are secured on a motor block 6 (shown partially) of the internal combustion engine. Control housing cover 4 covers a control chain 7 which drive-couples a camshaft (not shown) with a crankshaft 8 of the internal combustion engine. A drive chain 9 extends within the oil sump 5 and drive-couples the crankshaft with an oil pump (not shown).

Stator 2 is coaxially mounted with respect to rotational axis 10 of crankshaft 8, whereby crankshaft 8 extends through control housing cover 4, through an opening 11 that is concentric to stator 2. The suitable sealants 12 seal of crankshaft 8 to control housing cover 4.

A pot-like carrier 14 is connected with torsionally coupled to crankshaft 8 by means of a fastening screw 13. At an end facing away from crankshaft 8, carrier 14 has a support ring 15 extending all around. A rotational vibration damper 16 is radially secured on the outside of support ring 15. Rotary vibration damper 16 is radially secured on the outside of a ring collar 17 of rotor 3. Ring collar 17 projects substantially radially from rotor 3 on a side facing away from crankshaft 8. Rotational vibration damper 16 is vulcanized onto support ring 15 and/or ring collar 17.

On the outside of ring collar 17, belt pulley ribs 18 are radially supported so that ring collar 17 forms a belt pulley 19 that drives a belt 20 of the belt drive of the internal combustion engine (not shown in detail). Belt pulley 19 forms a component of rotor 3, whereby belt pulley 19 is driven by crankshaft 8 via rotor 3. The belt drive powers conventional auxiliary components such as a coolant pump or a power steering pump.

Since belt pulley 19 is formed on the axially projecting ring collar 17 of rotor 3, ring collar 17 and belt pulley 19 have a smaller diameter than rotor 3. In case belt pulley 19 has a diameter that is equal to the diameter of rotor 3, axially projecting ring collar 17 can be omitted and belt pulley ribs 18 can be radially mounted directly on the outside of rotor 3. This results in an overall reduction of the installation space. Furthermore, construction is possible in conjunction with modern internal combustion engines without belt pulley 19.

FIG. 1 also shows rotor 3 forming an outer cover of starter-generator 1 in the radial direction. The outer cover is exposed to an environment 21 of the internal combustion engine. In the axial direction, rotor 3 and carrier 14 define starter-generator 1 in environment 21. Starter-generator 1 shows an open type of construction that does not require an additional housing, and therefore saves structural space. In addition, the dissipation of heat of the starter-generator is enhanced at the same time.

A ring-shaped collar 22 is coaxially formed on control housing cover 4 and on oil sump 5 with respect to rotation axis 10. Collar 22 projects from control housing cover 4 and oil sump 5 in the axial direction. Ring-shaped collar 22 has a radial spacing from rotor 3, forming a ring gap 23. Furthermore, ring-shaped collar 22 overlaps rotor 3 in the axial direction at least in an end section of rotor 3 facing crankshaft 8. In the present embodiment, the length of the axial overlap approximately corresponds with the radial spacing between rotor 3 and ring-shaped collar 22. With the help of ring-shaped collar 22, liquid collecting on control housing cover 4 cannot directly penetrate the starter-generator 1, and drains, bypassing starter-generator 1 along control housing cover 4 or oil sump 5. Furthermore, the axial overlap generates a sealing effect of the type of a labyrinth packing, which protects the interior of starter-generator 1 against contamination.

Figure 2:
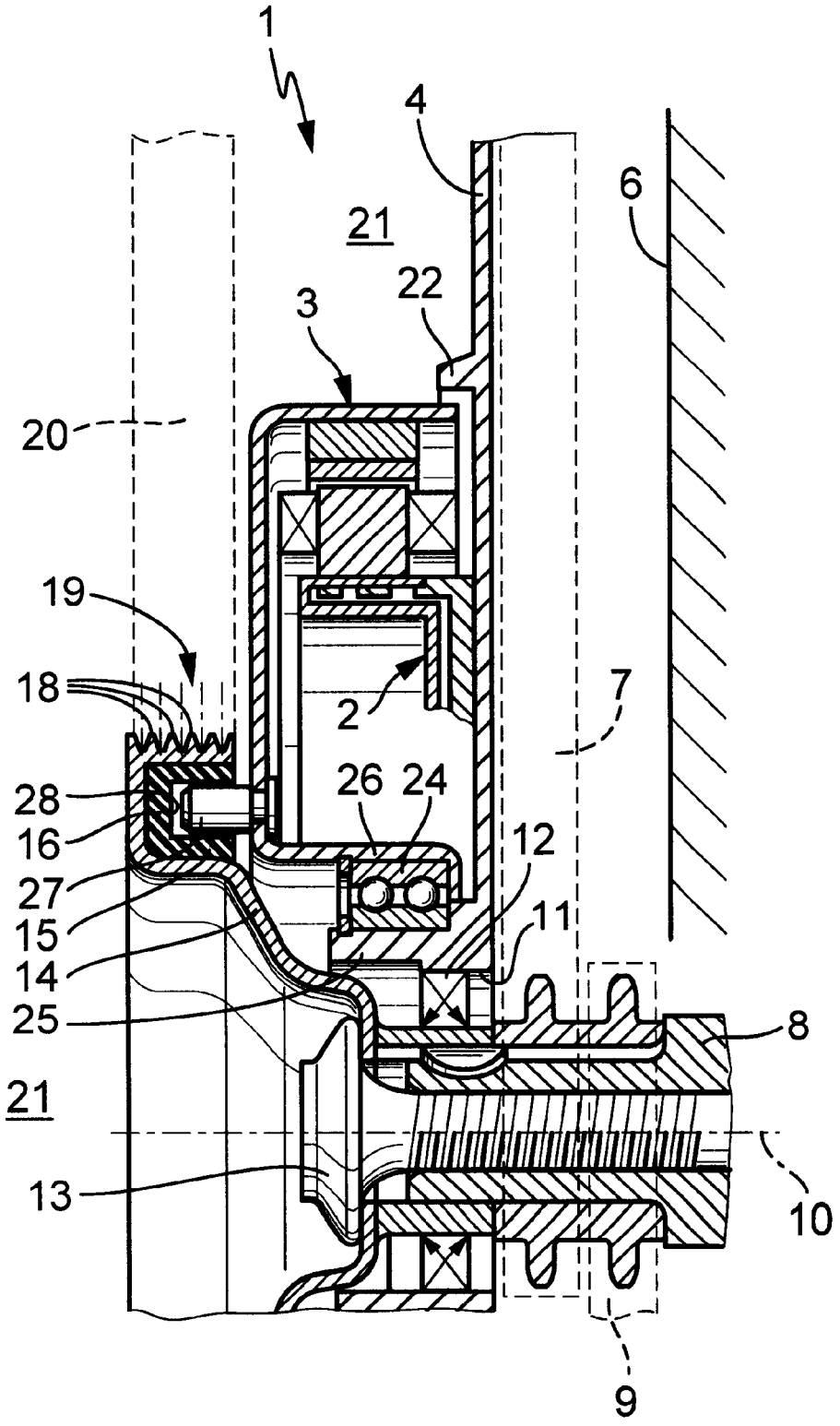
FIG. 2 shows a partial longitudinal cross sectional view of a second embodiment according to the invention.

Referring to FIG. 2, rotor 3 is supported on a radial bearing 24, which is mounted on control housing cover 4. Radial bearing 24 is supported radially on the inside of a sleeve 25, which coaxially projects from control housing cover 4 to the outside with respect to axis of rotation 10. Radial bearing 24 is radially supported on the outside of rotor 3 via a support ring 26, which is radially formed on the inside of rotor 3. In this way, rotor 3 is supported independently of belt pulley 19.

A driver 27 is secured on rotor 3. In the present case, driver 27 is formed as a pin that projects from rotor 3, parallel with respect to the axis of rotation 10. Although only one such driver 27 is shown in the present case, a plurality of such drivers 27 can be disposed along the periphery. Driver 27 projects into a recess 28 formed in rotational vibration damper 16, which torsionally couples rotor 3 to carrier 14 via driver or drivers 27 and also with belt pulley 19. Since this coupling is accompanied by a rotational vibration damper 16, vibrations of carrier 14 and belt pulley 19 are not transmitted to rotor 3, or transmitted only damped, which provides a relatively smooth running quality. Due to the support of rotor 3 on control housing cover 4, particularly narrow radial gap widths between rotor 3 and stator 2 can be provided when the starter-generator 1 is in operation.

In the present case, a preferred embodiment is without belt pulley 19, which provides a more compact type of construction. Drivers 27 radially engage the corresponding recesses 28 of the rotational vibration damper.

An important advantage of the starter-generator 1 as defined by the invention is in the selected installation position, which is exposed to comparatively low development of heat. It can also be cooled inexpensively by a flow of cooling air.

As a further advantage, different types of starter-generators 1 can be installed without having to make costly changes to the internal combustion engine. For example, starter-generators 1 may be different from each other with respect to their capacity, whereby a change in capacity is normally accompanied by a change in their dimensions. In particular, it is possible to vary its length, or change its diameter to obtain another power profile. Due to the structure of starter-generator 1 as defined by the invention, a change in its geometry, e.g. a changed length does not ensue any structural change of motor block 6. The same applies to a change in the diameter, as long as adequate space is available in the radial direction.

Accordingly, while only a few embodiments of the present invention have been shown and described, it is obvious that many changes and modifications may be made thereunto without departing from the spirit and scope of the invention.

What is claimed is:

1. A crankshaft driven starter-generator, having internal and external sides, for mounting on a motor block of an internal combustion engine for performing as a starter and a generator, comprising:

a stator disposed on said internal side of said starter-generator, said stator being torsionally coupled to the motor block of the internal combustion engine;

a rotor disposed on said external side of said starter-generator and drive-coupled with the crankshaft;

a carrier coaxially disposed with respect to the crankshaft and drive-coupled to the crankshaft, wherein said carrier is coaxially arranged and torsionally coupled to said rotor;

at least one driver, wherein said rotor is supported independently of said carrier, and said rotor is torsionally coupled with said carrier by said at least one driver; and a rotational vibration damper for drive-coupling said rotor with said carrier, wherein said carrier is torsionally coupled with the crankshaft.

2. The starter-generator according to claim 1, wherein said carrier supports a belt pulley.

3. The starter-generator according to claim 2, wherein said carrier supports said belt pully via said rotational vibration damper.

4. The starter-generator according to claim 1, wherein said at least one driver engages a recess formed in said rotational vibration damper.

5. The starter-generator according to claim 4, wherein said at least one driver engages said recess with axial or radial play.

6. The starter-generator according to claim 1, wherein said stator is secured on a control housing cover, said control housing cover being fastened on the motor block of the internal combustion engine.

7. The starter-generator according to claim 6, wherein said stator is secured on an oil sump, said oil sump being fastened on the motor block of the internal combustion engine.

8. The starter-generator according to claim 7, further comprising a ring-shaped collar formed on at least one of the following: motor block, control housing cover, and oil sump, said ring-shaped collar being arranged coaxially with respect to said stator and having a radial spacing from said rotor, partially overlapping said rotor in the axial direction.

9. The starter-generator according to claim 1, wherein said rotor forms an outer cover of the starter-generator in a radial direction, said outer cover being exposed to an environment of the internal combustion engine.

10. The starter-generator according to claim 1, wherein said rotor is supported on the motor block by a radial bearing.

11. The starter-generator according to claim 10, wherein said radial bearing is radially disposed in said rotor.

12. The starter-generator according to claim 10, wherein said radial bearing is axially disposed between said rotor and the motor block.

13. The starter-generator according to claim 10, wherein said radial bearing is radially disposed in said stator.

14. The starter-generator according to claim 10, wherein said radial bearing is axially disposed between said rotor and a structural component.

15. A crankshaft driven starter-generator, having internal and external sides, for mounting on a motor block of an internal combustion engine for performing as a starter and a generator, comprising:

a stator disposed on said internal side of said starter-generator, said stator being torsionally coupled to the motor block of the internal combustion engine;

a rotor disposed on said external side of said starter-generator and drive-coupled with the crankshaft, wherein said rotor forms an outer cover of the starter-generator in a radial direction, said outer cover being exposed to an environment of the internal combustion engine; and a carrier coaxially disposed with respect to the crankshaft and drive-coupled to the crankshaft, wherein said carrier is coaxially arranged and torsionally coupled to said rotor.

16. A crankshaft driven starter-generator, having internal and external sides, for mounting on a motor block of an internal combustion engine for performing as a starter and a generator, comprising:

a stator disposed on said internal side of said starter-generator, said stator being torsionally coupled to the motor block of the internal combustion engine;

a rotor disposed on said external side of said starter-generator and drive-coupled with the crankshaft, wherein said rotor is supported on the motor block by a radial bearing that is radially disposed in said stator; and a carrier coaxially disposed with respect to the crankshaft and drive-coupled to the crankshaft, wherein said carrier is coaxially arranged and torsionally coupled to said rotor.

* * * * *